US010018951B2

(12) United States Patent
Saito et al.

(10) Patent No.: US 10,018,951 B2
(45) Date of Patent: Jul. 10, 2018

(54) IMAGE FORMING APPARATUS WITH CONTROLLABLE VELOCITY RATIO BETWEEN IMAGE AND DEVELOPER BEARING MEMBERS

(71) Applicant: CANON KABUSHIKI KAISHA, Tokyo (JP)

(72) Inventors: Tohru Saito, Mishima (JP); Akihiko Uchiyama, Mishima (JP); Hisashi Nakahara, Numazu (JP); Go Shindo, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/472,572

(22) Filed: Mar. 29, 2017

(65) Prior Publication Data

US 2017/0285546 A1 Oct. 5, 2017

(30) Foreign Application Priority Data

Mar. 31, 2016 (JP) ..... 2016-072514

(51) Int. Cl.
*G03G 15/00* (2006.01)

(52) U.S. Cl.
CPC ..... *G03G 15/5062* (2013.01)

(58) Field of Classification Search
CPC ..... G03G 15/5062; G03G 15/01; G03G 15/5008; G03G 15/50
See application file for complete search history.

(56) References Cited

U.S. PATENT DOCUMENTS

2009/0208232 A1* 8/2009 Maezawa ..... G03G 15/0806 399/60
2012/0086987 A1* 4/2012 Tamura ..... G03G 15/011 358/3.24

FOREIGN PATENT DOCUMENTS

JP 08-227222 A 9/1996
JP 2013-114252 A 6/2013
JP 2013-210489 A 10/2013

OTHER PUBLICATIONS

U.S. Appl. No. 15/459,384, filed Mar. 15, 2017, Hisashi Nakahra, Akihiko Uchiyama.

* cited by examiner

*Primary Examiner* — Sandra Brase
(74) *Attorney, Agent, or Firm* — Fitzpatrick, Cella, Harper & Scinto

(57) ABSTRACT

A control portion has a conversion portion that converts image data to be used for forming a recorded image by using either a first conversion condition which has been set such as to obtain a first gradation characteristic in the image to be formed on the recording material when a first image forming operation is executed or a second conversion condition which has been set such as to obtain a second gradation characteristic, which is different from the first gradation characteristic, in the image when a second image forming operation is executed, a peripheral velocity ratio between an image bearing member and a developer bearing member being larger during the second image forming operation than during the first image forming operation, and enables the first image forming operation or the second image forming operation to be performed on the basis of converted image data.

18 Claims, 15 Drawing Sheets

LUT 1 FOR NORMAL IMAGE FORMING MODE IS USED
IN WIDE GAMUT IMAGE FORMING MODE (CONVENTIONAL EXAMPLE)

COMPARATIVE EXAMPLE

IMAGE FORMING APPARATUS WITH CONTROLLABLE VELOCITY RATIO BETWEEN IMAGE AND DEVELOPER BEARING MEMBERS

BACKGROUND OF THE INVENTION

Field of the Invention

The present invention relates to an image forming apparatus using an electrophotographic method.

Description of the Related Art

In recent years, in an image forming apparatus in which a color image is formed on a recording material by using an electrophotographic method, such as a color laser printer, color gamut has become important as one of high image quality indexes of the output image. The color gamut represents a color reproduction range that can be reproduced by the image forming apparatus, and a wider color gamut corresponds to a wider color reproduction range. As a method of enlarging the color gamut, for example, in a color image forming apparatus, dense Y, dense M, and dense C developers are used in addition to developers of four colors Y, M, C and K that are usually used, and a wide color gamut is realized by using developers with more than four colors.

As another method, it is conceivable to increase the color gamut of the output image fixed to the recording material to above the usual level by increasing the amount of developer (referred to hereinbelow as "toner amount") placed on the recording material to above the usual level. Further, as a method for changing the toner amount, it is conceivable to change the peripheral velocity ratio of a photosensitive drum as an image bearing member and a developing roller as a developer bearing member. As a method for changing the peripheral velocity ratio of the photosensitive drum and the developing roller, Japanese Patent Application Publication No. H8-227222 suggests a method for adjusting the tinge of the secondary color (red color) by changing the rotation speed of the developing roller. Further, Japanese Patent Application Publication No. 2013-210489 suggests a method for improving image graininess, that is, reducing toner scattering and image blurring, by reducing the rotation speed of the photosensitive drum.

SUMMARY OF THE INVENTION

However, the following problems are associated with the abovementioned conventional examples. With the method using developers of more than four colors by adding dense Y, dense M, and dense C developers, the number of image forming units increases correspondingly to the increase in the number of developers, and therefore, the image forming apparatus becomes larger. Further, the objective of the method disclosed in Japanese Patent Application Publication No. 2013-210489 in which the peripheral velocity of the photosensitive drum is made to be different from the peripheral velocity of the developing roller is to adjust the tinge and improve the image graininess, and it is not always possible to expand the color gamut advantageously. That is, with the methods disclosed in Japanese Patent Application Publication Nos. H8-227222 and 2013-210489, an image having an unnatural tinge is sometimes obtained.

It is an objective of the present invention to provide a technique capable of reducing an unnatural tinge.

In order to achieve the abovementioned objective, the image forming apparatus of the present invention is an image forming apparatus comprising:

an image bearing member on which an electrostatic image is formed;

a developer bearing member that develops the electrostatic image, which has been formed on the image bearing member, with a developer; and a control portion that controls the image bearing member and the developer bearing member such as to enable execution of a first image forming operation by which a recorded image is formed by rotating the image bearing member and the developer bearing member at a first peripheral velocity ratio and a second image forming operation by which a recorded image is formed by rotating the image bearing member and the developer bearing member at a second peripheral velocity ratio which is greater than the first peripheral velocity ratio, where the peripheral velocity ratio is defined as a ratio of a peripheral velocity of the developer bearing member to a peripheral velocity of the image bearing member, wherein the control portion has a conversion portion that converts image data, which are used for forming the recorded image, by using either a first conversion condition which has been set such as to obtain a first gradation characteristic in the recorded image when the first image forming operation is executed or a second conversion condition which has been set such as to obtain a second gradation characteristic, which is different from the first gradation characteristic, in the recorded image when the second image forming operation is executed, and enables the first image forming operation or the second image forming operation to be performed on the basis of image data converted by the conversion portion.

In order to achieve the abovementioned objective, the image forming apparatus of the present invention is an image forming apparatus comprising:

an image bearing member on which an electrostatic image is formed;

a developer bearing member that develops the electrostatic image, which has been formed on the image bearing member, with a developer; and a control portion that controls the image bearing member and the developer bearing member such as to enable execution of a first image forming operation by which a recorded image is formed by rotating the image bearing member and the developer bearing member at a first peripheral velocity ratio and a second image forming operation by which a recorded image is formed by rotating the image bearing member and the developer bearing member at a second peripheral velocity ratio which is greater than the first peripheral velocity ratio, where the peripheral velocity ratio is defined as a ratio of a peripheral velocity of the developer bearing member to a peripheral velocity of the image bearing member, wherein the control portion has a conversion portion that converts image data, which are used for forming the recorded image, by using either a first conversion condition for outputting the recorded image in a first color reproduction range when the first image forming operation is executed or a second conversion condition for outputting the recorded image in a second color reproduction range, which is wider than the first color reproduction range, when the second image forming operation is executed, and enables the first image forming operation or the second image forming operation to be performed on the basis of image data converted by the conversion portion.

According to the present invention, it is possible to reduce the occurrence of an unnatural tinge.

Further features of the present invention will become apparent from the following description of exemplary embodiments with reference to the attached drawings.

and

Figure 15:
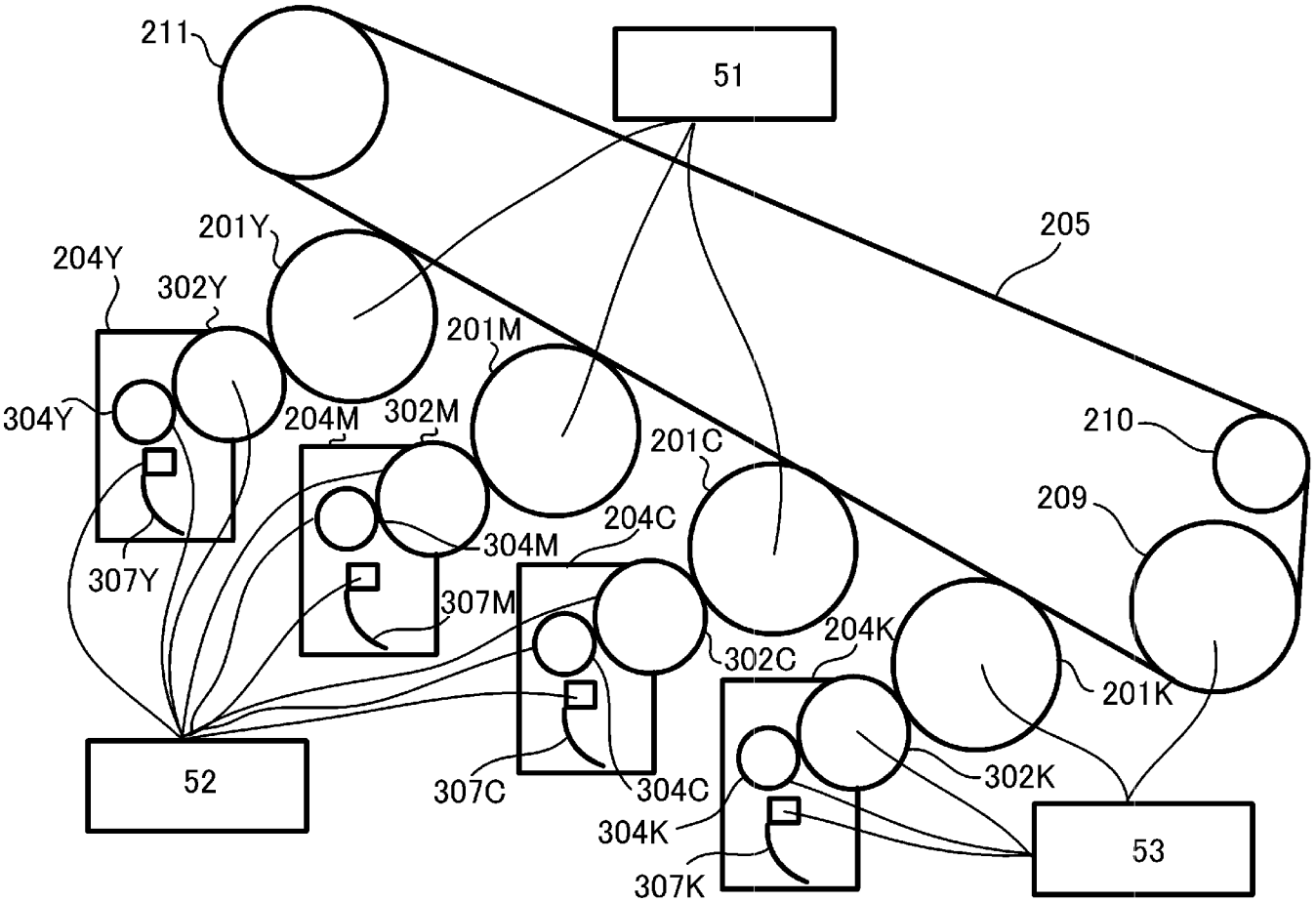

FIG. 15 is a schematic diagram of a drive coupling configuration in an example of the present invention.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

EXAMPLE 1

Examples of the image forming apparatus to which the present invention is applied include a copier, a laser beam printer (LBP), a printer, a facsimile machine, a microfilm reader/printer, and a recorder using an electrophotographic image forming process. In these image forming apparatuses, an unfixed toner image of target image information, which has been formed and borne on a recording material (transfer material, printing paper, photosensitive paper, glossy paper, OHT, electrostatic recording paper, etc.) by an intermediate transfer method or a direct transfer method in an image producing process portion is fixed as a fixed image.

The image forming apparatus according to the present example has two image forming modes, namely, a normal image forming mode in which a normal image density is obtained as a first image forming operation and a wide color gamut image forming mode in which a wide color gamut image can be reproduced as a second image forming operation. The first image forming operation and the second image forming operation are controlled in an executable manner by a control portion. In the wide color gamut image forming mode, the peripheral velocity ratio of the photosensitive drum as an image bearing member and the developing roller as a developer bearing member, that is, the ratio of the peripheral velocity of the developing roller to the peripheral velocity of the photosensitive drum, is changed. Therefore, the peripheral velocity ratio of the photosensitive drum and the developing roller differs between the image forming modes. In the present example, the first image forming operation is the normal image forming mode and the second image forming operation is the wide color gamut image forming mode, but the present invention is not limited thereto. When two kinds of normal image density are set, the first image forming operation is the first normal image forming mode and the second image forming operation is the second normal image forming mode.

A specific feature of the present example is that different image formation conditions are used in the normal image forming mode and the wide color gamut image forming mode. Here, using different image formation conditions means, for example, that specifications of processing in various types of image processing such as color matching, color separation, γ correction, and halftoning, that is, conversion conditions (processing conditions) between original image data (first image data) and image data after processing (second image data), are changed. In Example 1, the case is described in which different γ corrections (first γ correction and second γ correction) suitable for the respective modes are performed as the image formation conditions in the normal image forming mode and the wide color gamut image forming mode.

Figure 1:
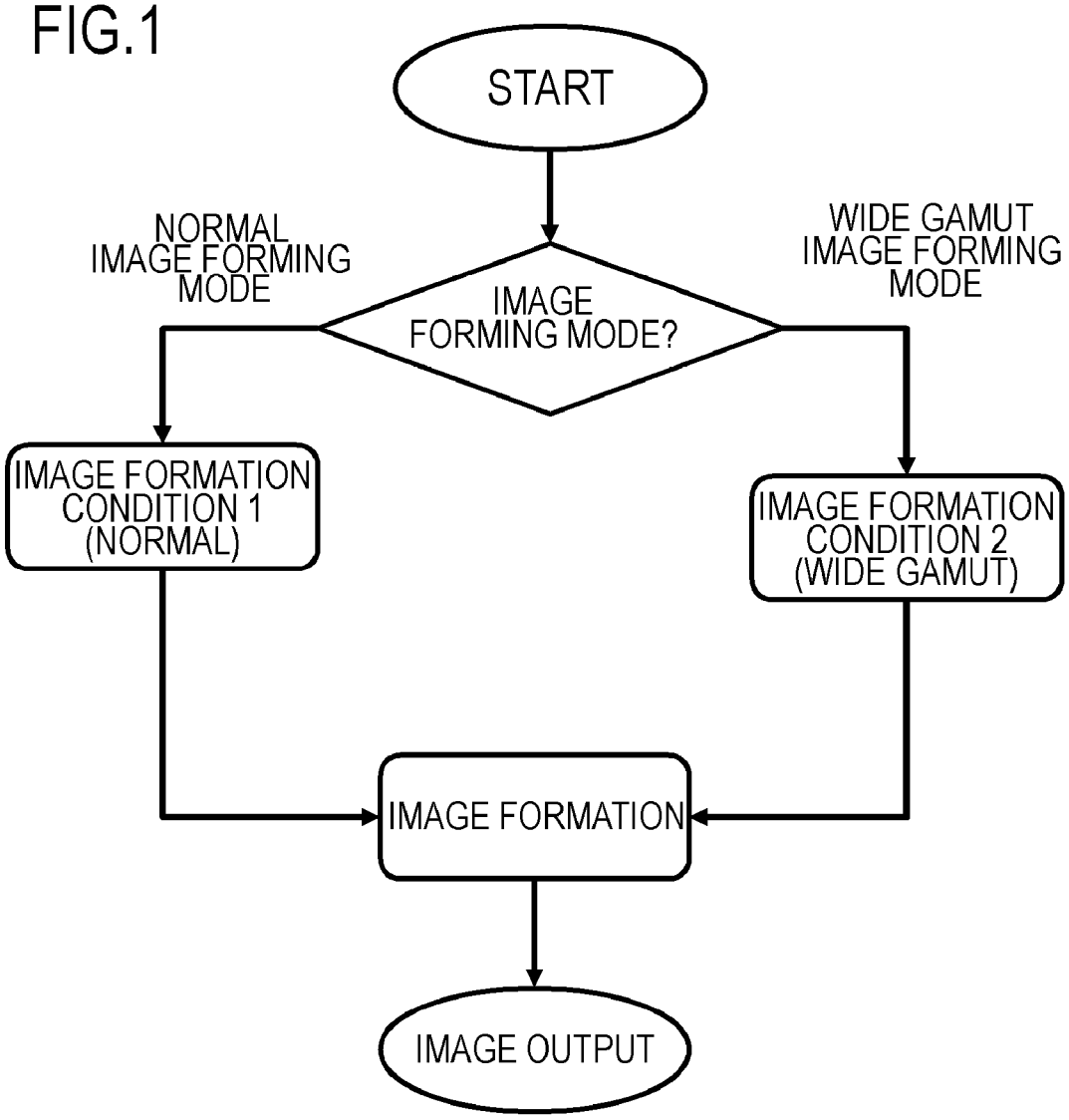
FIG. 1 is a flowchart of the image processing operation in Example 1 of the present invention.

FIG. 1 is a flowchart showing the flow of the image processing operation in the example. As shown in FIG. 1, in the present example, image formation conditions to be used in the normal image forming mode and the wide color gamut image forming mode are changed.

Figure 14:
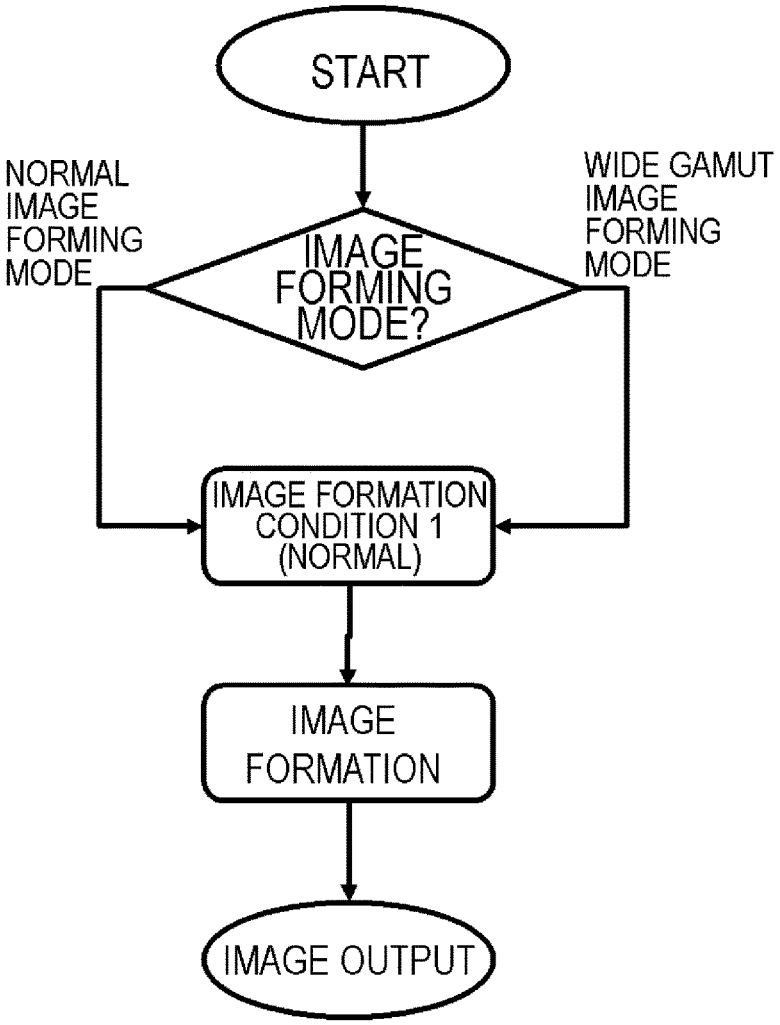
FIG. 14 is a flowchart of the image processing operation in the conventional example.

FIG. 14 is a flowchart showing the flow of the image forming process in the conventional example. As shown in FIG. 14, in the conventional example, image formation conditions used in the normal image forming mode and the wide color gamut image forming mode are the same.

(Image Forming Apparatus)

Figure 2:
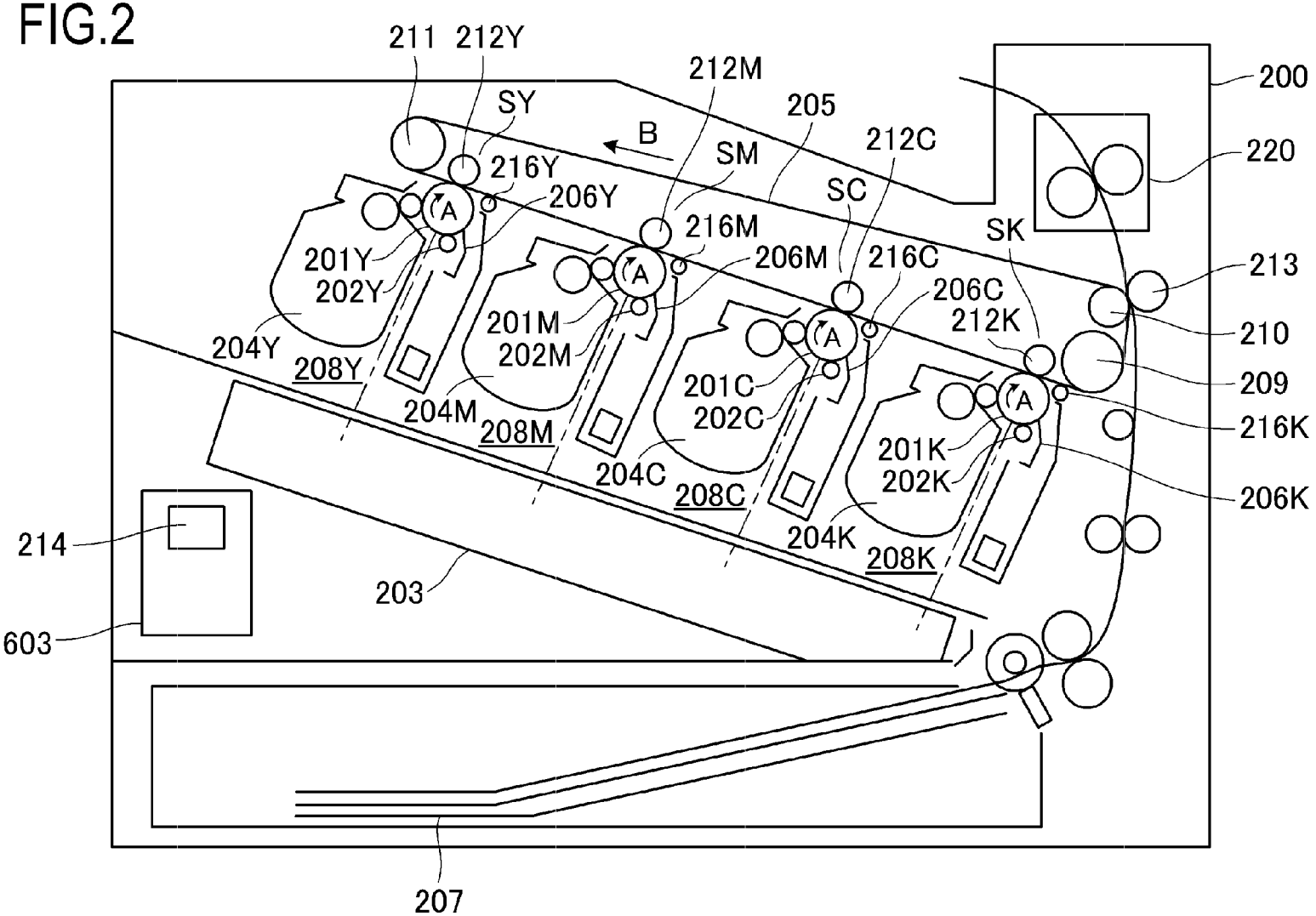
FIG. 2 is a schematic cross-sectional view of the image forming apparatus according to Example 1 of the present invention.

FIG. 2 is a schematic cross-sectional view of an image forming apparatus 200 according to an example of the present invention. The image forming apparatus 200 of the present example is a full-color laser printer using an in-line method and an intermediate transfer method. The image forming apparatus 200 can form a full color image on a recording material (for example, recording paper such as plain paper) according to image information. The image information is sent to the image forming apparatus 200 from an image reading device connected to the image forming apparatus 200, or a host PC (not shown in the drawing) such as a personal computer communicably connected to the image forming apparatus 200. The sent image information is inputted to an engine controller 603 as a control portion having a CPU 214 or a memory located in the image forming apparatus 200, or to a video controller 602 as a conversion portion. Various operations including the image forming operation in the image forming apparatus 200 are controlled by the engine controller 603 as a control portion.

The image forming apparatus 200 includes, as a plurality of image forming portions, first, second, third, and fourth image forming portions SY, SM, SC, and SK for forming images of yellow (Y), magenta (M), cyan (C), and black (K) colors, respectively. Here, the image forming portion (or image forming station) is configured of a process cartridge 208 and a primary transfer roller 212 disposed to face the process cartridge, with an intermediate transfer belt 205 being interposed therebetween. In the present example, the first to fourth image forming portions SY, SM, SC, and SK are disposed in a row in a direction intersecting the vertical direction and the horizontal direction. In the present example, the first to fourth image forming portions have substantially the same configuration and operation, except for the color of the image to be formed. Therefore, in the following general description, the suffixes Y, M, C, and K assigned to the code for indicating that an element is provided for a specific color are omitted, in particular, when no distinction is required. Such a configuration is, however, not limiting. For example, the image forming portion itself may be made large by increasing the capacity of black (K).

The image forming apparatus 200 includes, as a plurality of image carriers, four drum-shaped electrophotographic photosensitive members, that is, photosensitive drums 201, arranged side by side in a direction intersecting the vertical direction and the horizontal direction. The photosensitive drum 201 is rotationally driven by driving means (driving source) (not shown in the drawing) in the direction of an arrow A (clockwise direction) in the drawing. A charging roller 202 and a scanner unit (exposure device) 203 are disposed on the periphery of the photosensitive drum 201. The charging roller 202 is charging means for uniformly charging the surface of the photosensitive drum 201. The scanner unit 203 is an exposure portion that forms an electrostatic image (electrostatic latent image) on the photosensitive drum 201 by irradiation with a laser beam on the basis of image information. A developing unit (developing device) 204, a cleaning blade 206, and a pre-exposure LED 216 are also disposed on the periphery of the photosensitive drum 201. The developing unit 204 is developing means for developing the electrostatic image as a toner image (developer image). The cleaning blade 206 is cleaning means for removing the toner (untransferred toner) remaining on the surface of the photosensitive drum 201 after the transfer. The pre-exposure LED 216 is static eliminating means for neutralizing the potential on the photosensitive drum 201.

An intermediate transfer belt 205 as an intermediate transfer member for transferring a toner image as a developer image on the photosensitive drum 201 to a recording material 207 is disposed so as to face the four photosensitive drums 201. The photosensitive drums 201, the charging roller 202 as charging process means of the photosensitive drum 201, the developing unit 204, and the cleaning blade 206 are integrally configured in the process cartridge 208. The process cartridge 208 is detachably attachable to the apparatus main body of the image forming apparatus 200. The apparatus main body, as referred to herein, indicates constituent parts of the image forming apparatus 200 excluding the process cartridge 208. In the present example, the process cartridges 208 for the respective colors have the same shape, and toners of yellow (Y), magenta (M), cyan (C), and black (K) colors are accommodated in the process cartridges 208 for the respective colors. Further, the toner in the present example has a negative charging characteristic.

The intermediate transfer belt 205 formed of an endless belt as an intermediate transfer member comes into contact with all of the photosensitive drums 201 and rotates in the direction of an arrow B (counterclockwise direction) in the drawing. The intermediate transfer belt 205 is wound around a driving roller 209, a secondary transfer opposing roller 210, and a driven roller 211 as a plurality of support members. On the inner peripheral surface side of the intermediate transfer belt 205, four primary transfer rollers 212 are disposed side by side as primary transfer portion so as to face the respective photosensitive drums 201. Further, a bias having a polarity opposite to the regular charging polarity (as described above, negative polarity in the present example) of the toner is applied from a primary transfer bias power source (not shown in the drawing) to the primary transfer roller 212. As a result, the toner image on the photosensitive drum 201 is transferred onto the intermediate transfer belt 205. Further, a secondary transfer roller 213 is disposed as secondary transfer portion at a position facing the secondary transfer opposing roller 210 on the outer peripheral surface side of the intermediate transfer belt 205. A bias having a polarity opposite to the regular charging polarity of the toner is applied from a secondary transfer bias power supply (not shown in the drawing) to the secondary transfer roller 213. As a result, the toner image on the intermediate transfer belt 205 is transferred onto the recording material 207. The toner image is then heated and fixed by a fixing device 220 as a fixing portion disposed on the downstream side, whereby the toner image is fixed as a fixed image on the recording material 207.

(Process Cartridge)

Figure 3:
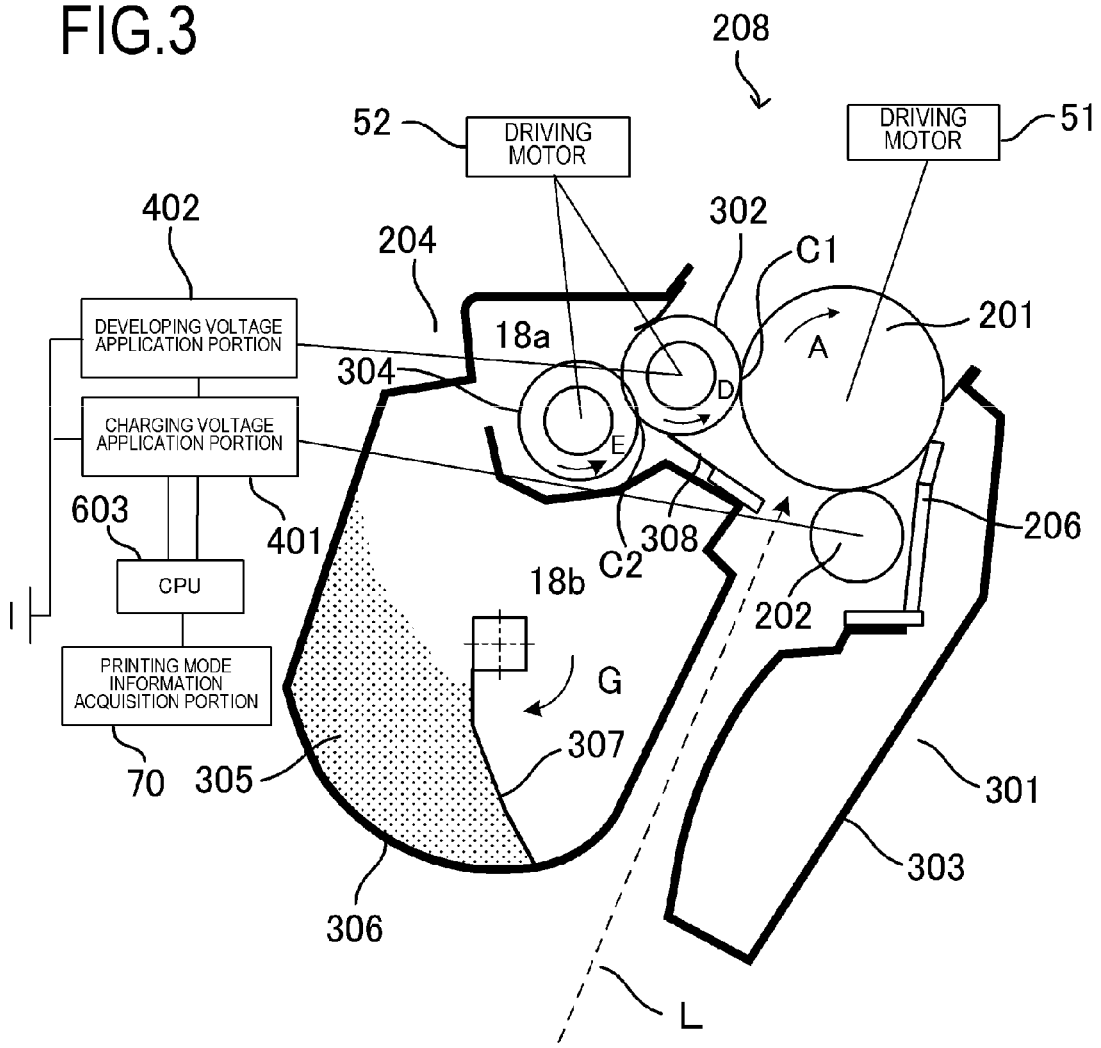
FIG. 3 is a cross-sectional view of the process cartridge in Example 1 of the present invention.

FIG. 3 is a schematic cross-sectional view of the process cartridge 208 of the present example as seen from the longitudinal direction (rotational axis direction) of the photosensitive drum 201. In the present example, the configuration and operation of the process cartridges 208 for each color are the same except for the type (color) of the developer accommodated therein, and FIG. 3 shows, by way of example, the process cartridge for yellow (Y) color. The process cartridge 208 includes a photosensitive member unit 301 having a photosensitive drum 201, or the like, as an image bearing member, and a developing unit 204 having a developing roller 302 or the like. The photosensitive member unit 301 has a cleaning frame 303 as a frame that supports various elements in the photosensitive member unit 301. The photosensitive drum 201 is rotatably attached to the cleaning frame 303 through a bearing (not shown in the drawing). The photosensitive drum 201 is rotationally driven in the direction of an arrow A (clockwise direction) in the drawing in accordance with the image forming operation by transmitting the driving force of the below-described driving motor as driving portion (driving source) to the photosensitive member unit 301. The photosensitive drum 201, which is the principal component of the image forming process, uses an organic photosensitive drum in which an undercoat layer which is a functional film, a carrier generating layer, and a carrier transfer layer are sequentially coated on the outer peripheral surface of an aluminum cylinder. Further, in the photosensitive member unit 301, the cleaning member 206 and the charging roller 202 are disposed so as to be in contact with the peripheral surface of the photosensitive drum 201. The untransferred toner removed from the surface of the photosensitive drum 201 by the cleaning member 206 falls down and is accommodated in the cleaning frame 303.

The charging roller 202 serving as charging portion is driven to rotate by pressing a roller portion made from an electrically conductive rubber into contact with the photosensitive drum 201 as an image bearing member. Here, in the core metal of the charging roller 202, as a charging step, a predetermined DC voltage is applied as a charging bias to the photosensitive drum 201 from a charging voltage application portion (high-voltage power source) 401 as charging roller bias application means. As a result, a uniform dark potential (Vd) is formed on the surface of the photosensitive drum 201. The aforementioned scanner unit 203 exposes the photosensitive drum 201 by a laser beam L emitted correspondingly to the image data. Electric charges on the surface in the exposed photosensitive drum 201 are eliminated by the carriers from the carrier generating layer, and the electric potential decreases. As a result, an electrostatic latent image with a predetermined light potential (Vl) at the exposed segment and a predetermined dark potential (Vd) at the unexposed segment is formed on the photosensitive drum 201.

The developing unit 204 has a developing roller 302 (rotation direction is indicated by an arrow D) as a developer bearing member, a developing blade 308, a toner supply roller 304 (rotation direction is indicated by an arrow E), a toner 305, a toner accommodating chamber 306 that accommodates the toner 305, and an agitating member 307. The toner accommodating chamber 306 has a developing chamber 18*a* and a developer accommodating chamber 18*b*. The developer accommodating chamber 18*b* is disposed below the developing chamber 18*a* and communicates with the developing chamber 18*a* via a communication port provided above the developer accommodating chamber 18*b*. The toner 305 is moved in the toner accommodating chamber 306 by the movement (rotation direction is indicated by an arrow G) of the agitating member 307 as a developer transport member. In the present example, as described above, a toner having a negative polarity as a regular charge polarity is used as toner 305, and the following explanation is based on the case of using a negative-charging toner. However, the toner that can be used in the present invention is not limited to the negative-charging toner, and depending on the apparatus configuration, a toner having a positive polarity as a regular charge polarity may be used.

The developing roller 302 as a developer bearing member that is in contact with the photosensitive drum 201 as an image bearing member and rotates in the direction indicated by an arrow D in the drawing by receiving a driving force of a driving motor 52 or a driving motor 53 shown in FIG. 15 as driving portion is provided in the developing chamber 18*a*. In the present example, the developing roller 302 and the photosensitive drum 201 rotate such that the surfaces thereof move in the same direction in an opposing portion (contact portion C1) which is a segment where the toner 305 carried by the developing roller 302 is supplied to the photosensitive drum 201. Further, a predetermined DC bias (developing bias) sufficient to develop and visualize the electrostatic latent image on the photosensitive drum 201 as a toner image (developer image) is applied from a developing voltage application portion (high-voltage power source) 402 serving as developing bias application means to the developing roller 302. At the contact portion C1 where the developing roller 302 and the photosensitive drum 201 are in contact with each other, the toner is transferred only to the light potential region from the potential difference, thereby visualizing the electrostatic latent image. Thus, the electrostatic latent image is an image configured of a light potential region as a first potential region for adhering the toner and a dark potential region as a second potential region for not adhering the toner.

A toner supply roller (referred to hereinbelow as "supply roller") 304 and a developing blade (referred to hereinbelow as "regulating member") 308 as a toner amount regulating member are further arranged in the developing chamber 18*a*. The supply roller 304 as a developer supply member is a roller for supplying the toner 305 transported from the developer accommodating chamber 18*b* to the developing roller 302. The supply roller 304 is an elastic sponge roller in which a foam layer is formed on the outer periphery of a conductive core metal. In the opposing portion of the supply roller facing the developing roller 302, a predetermined contact portion C2 (contact region) is formed where the supply roller 304 is in contact with the peripheral surface of the developing roller 302. The regulating member 308 regulates the coating amount of the toner on the developing roller 302, which is supplied by the supply roller 304, and imparts an electric charge thereto. A bias (supply bias) is applied to the supply roller 304 from a high-voltage power source (not shown in the drawing) serving as supply bias application portion.

Here, the bias applied by a developing voltage application portion 402, a charging voltage application portion 401, and the supply roller bias power source is controlled by an engine controller 603, which is a control portion, on the basis of the information obtained by a printing mode information acquisition portion 70. The printing mode information acquisition portion 70 acquires information inputted from an operation panel or a printer driver (not shown in the drawing) of the image forming apparatus 200, or a host PC.

As shown in FIG. 15, in the present example, the configuration of the driving portion for driving the shafts of the photosensitive drum 201, the developing roller 302, the agitating member 307, and the supply roller 304 differs depending on the process cartridge 208. FIG. 15 is a schematic diagram showing a drive coupling configuration in an example of the present invention.

Yellow (Y), magenta (M), and cyan (C) process cartridges 208 are configured in the following manner. Thus, as shown in FIG. 15, the driving portion for rotationally driving photosensitive drums 201Y, 201M, 201K and the driving portion for rotationally driving developing rollers 302Y, 302M, 302K are configured to have separate driving sources. The driving portion for rotationally driving the photosensitive drums 201Y, 201M, 201C is configured of a driving motor 51 and a gear train that transmits the rotational driving force of the driving motor 51. Meanwhile, the driving portion for rotationally driving the developing rollers 302Y, 302M, 302C is configured of a driving motor 52 and a gear train that transmits the rotational driving force of the driving motor 52. The driving motor 52, together with another gear train, also constitutes driving portion for rotationally driving the rotation shafts of agitating members 307Y, 307M, 307C. Further, the driving motor 52, together with still another gear train, also constitutes driving portion for rotationally driving supply rollers 304Y, 304M, 304C.

In the black (K) process cartridge 208, driving portion for rotationally driving the photosensitive drum 201K, driving portion for rotationally driving the developing roller 302K, and driving portion for rotationally driving the supply roller 304K are configured of a common single driving motor 53. Further, the driving motor 53, together with another gear train, constitutes driving portion for rotationally driving the rotation shaft of the agitating member 307K, and together with yet another gear train, constitutes driving portion for rotationally driving a driving roller 209 for circulatory moving the intermediate transfer belt 205. These various driving motors and gear trains correspond to driving portion capable of rotationally driving the image bearing member, the developer bearing member, the supply member, and the transport member individually and variably in the present invention, and are controlled by the engine controller 603 as a control portion.

Conventionally, the photosensitive drum and the developing roller are driven from the same driving source (driving motor) through a gear train. For this reason, the peripheral velocity ratio of the photosensitive drum and the developing roller is uniquely determined by the gear ratio and is fixed. By contrast, in the present example, in the YMC cartridge, the photosensitive drum and the developing roller are driven from separate driving sources, so that the peripheral velocity ratio of the photosensitive drum and the developing roller can be varied.

As an example of the toner that can be used in the present example, a substantially spherical toner is used that is produced by a polymerization method, includes a low-softening-point substance at 5 wt % to 30 wt %, and has a shape factor SF-1 of 100 to 110 (simply referred to hereinbelow as "polymerized toner"). The low-softening-point substance is a compound in which the main maximum peak value measured in accordance with ASTM D 3418-8 shows 40° C. to 90° C. The main maximum peak temperature of the polymerized toner is measured, for example, with DSC-7 manufactured by PerkinElmer, Inc. Temperature correction of the apparatus detection portion uses the melting points of indium and zinc, and the heat of fusion of indium is used for calorific value correction. The measurements were carried out at a heating rate of 10° C./min by using an aluminum pan as a sample and an empty pan as a reference. Specifically, paraffin waxes, polyolefins, Fischer-Tropsch wax, amide waxes, higher fatty acids, ester waxes and derivatives thereof or graft/block compounds thereof can be used. An ester wax is preferred that has one or more long-chain ester moieties with ten or more carbon atoms which are represented by the following general structural formula. The structural formulas of representative compounds of specific ester waxes are shown below as general structural formulas (1), (2) and (3).

(C1)

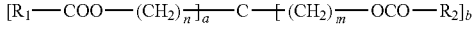

(1)

In the formula, a and b each represent an integer of 0 to 4, and a+b is 4. R1 and R2 each represent an organic group with the number of carbon atoms being an integer of 1 to 40, and the difference in the number of carbon atoms between R1 and R2 is at least 10. n and m each represent an integer of 0 to 15, and n and m are not 0 at the same time.

(C2)

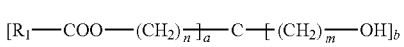

(2)

In the formula, a and b each represent an integer of 0 to 4, and a+b is 4. R1 represents an organic group with the number of carbon atoms being an integer of 1 to 40. n and m each represent an integer of 0 to 15, and n and m are not 0 at the same time.

(C3)

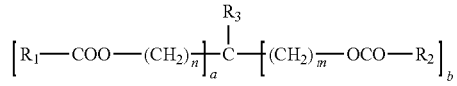

(3)

In the formula, a and b each represent an integer of 0 to 3, and a+b is not more than 3. R1 and R2 each represent an organic group with the number of carbon atoms being an integer of 1 to 40, and the difference in the number of carbon atoms between R1 and R2 is at least 10. R3 represents an organic group with at least one carbon atom. n and m each represent an integer of 0 to 15, and n and m are not 0 at the same time.

An ester wax preferably used in the present invention has a hardness of 0.5 to 5.0. The hardness of the ester wax is a value obtained by preparing a cylindrical sample having a diameter of 20 mm and a thickness of 5 mm and then measuring a Vickers hardness using a dynamic microhardness meter (DUH-200) manufactured by Shimadzu Corporation. The Vickers hardness is determined under the following measurement conditions: displacement of 10 μm is induced at a load speed of 9.67 mm/sec under a load of 0.5 g, followed by holding for 15 sec and measuring the shape of the obtained dent. The hardness of the ester wax preferably used in the present invention has a value of 0.5 to 5.0. Examples of specific compounds are represented by the following chemical formulas (4), (5), (6), and (7).

(C4)

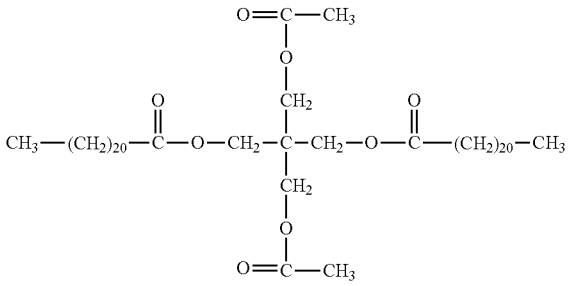

(4)

(C5)

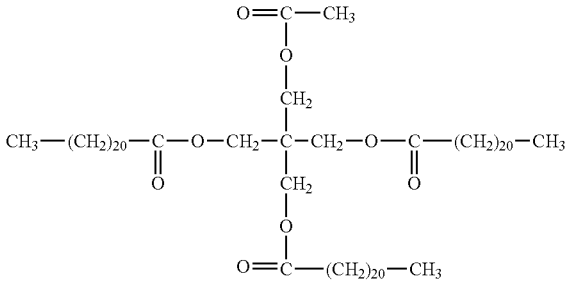

(5)

(C6)

-continued (6)

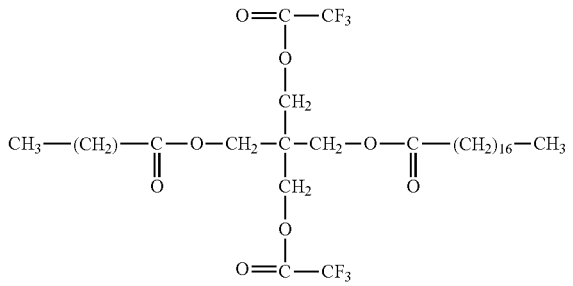

(C7)

(7)

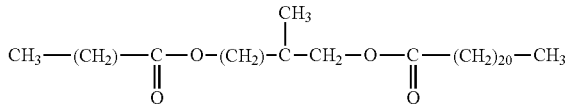

The shape factor SF-1, as referred to herein, is a numerical value indicating the ratio of the spherical roundness of a spherical substance, and is represented by a value obtained by dividing a second power of the maximum length MAXLNG of an elliptical figure formed by projecting the spherical substance onto a two-dimensional plane by the AREA of the figure and multiplying by 100π/4. In other words, the shape factor SF-1 is defined by the following equation.

$$[SF-1] = \frac{\pi \times \left(\frac{MAXLNG}{2}\right)^2}{\text{AREA}} \times 100 = \frac{(MAXLNG)^2}{\text{AREA}} \times \left(\frac{100\pi}{4}\right) \quad \text{(Math. 1)}$$

Calculations were performed by the equation above by randomly sampling 100 toner images using FE-SEM (S-800), manufactured by Hitachi, Ltd., introducing the image information via an interface to an image analyzer (Luzex 3), manufactured by Nireco Corporation, and analyzing the image information.

A cyan toner was prepared in the following manner. A total of 710 parts by weight of ion-exchanged water and 450 parts by weight of 0.1 mol/L aqueous $Na_3PO_4$ solution were added to a 21-L four-neck flask equipped with a high-speed stirrer, the revolution speed was adjusted to 12,000 rpm, and the solution was heated to 65° C. Then, 68 parts by weight of a 1.0 mol/L aqueous $CaCl_2$ solution was gradually added to prepare a dispersion medium system including a small amount of $Ca_3(PO_4)_2$ as a sparingly water-soluble dispersing agent.

Meanwhile, the dispersoid system is as follows:

Styrene monomer: 165 parts by weight.

n-Butyl acrylate monomer: 35 parts by weight.

C.I. Pigment Blue 15:30:14 parts by weight.

Saturated polyester: 10 parts by weight.

{Acid value of terephthalic acid-propylene oxide modified bisphenol A is 15, peak molecular weight: 6000.}

Salicylic acid metal compound: 2 parts by weight.

The following compound (maximum peak value: 59.4° C.): 60 parts by weight.

(C8)

(8)

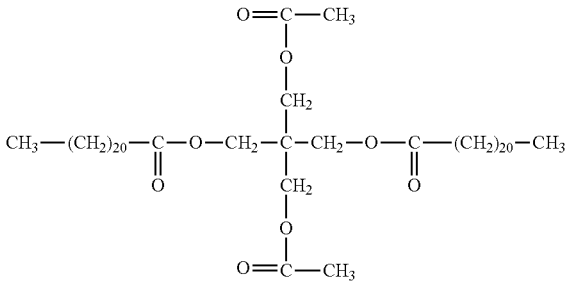

After dispersing the above mixture for 3 h by using an attritor, a dispersion matter to which 10 parts by weight of 2,2'-azobis(2,4-dimethylvaleronitrile) as a polymerization initiator was added was charged into the dispersion medium, and granulation was carried out for 15 min while maintaining the revolution speed. The stirrer was then changed from a high-speed stirrer to a propeller stirring blade, the internal temperature was raised to 80° C., and polymerization was continued for 10 h at 50 rpm. After completion of the polymerization, the slurry was cooled and dilute hydrochloric acid was added to remove the dispersion medium. After further washing and drying, the cyan toner had a weight-average particle diameter (measured by Coulter Counter) of 6.2 μm, a number variation factor of 27%, and a SF-1 of 104.

A yellow toner, a magenta toner, and a black toner having a SF-1 of 104 were produced in the same manner. C.I. Pigment Yellow 17, C.I. Pigment Red 122, and carbon black were used as colorants for the yellow toner, magenta toner, and black toner, respectively.

Figure 4:
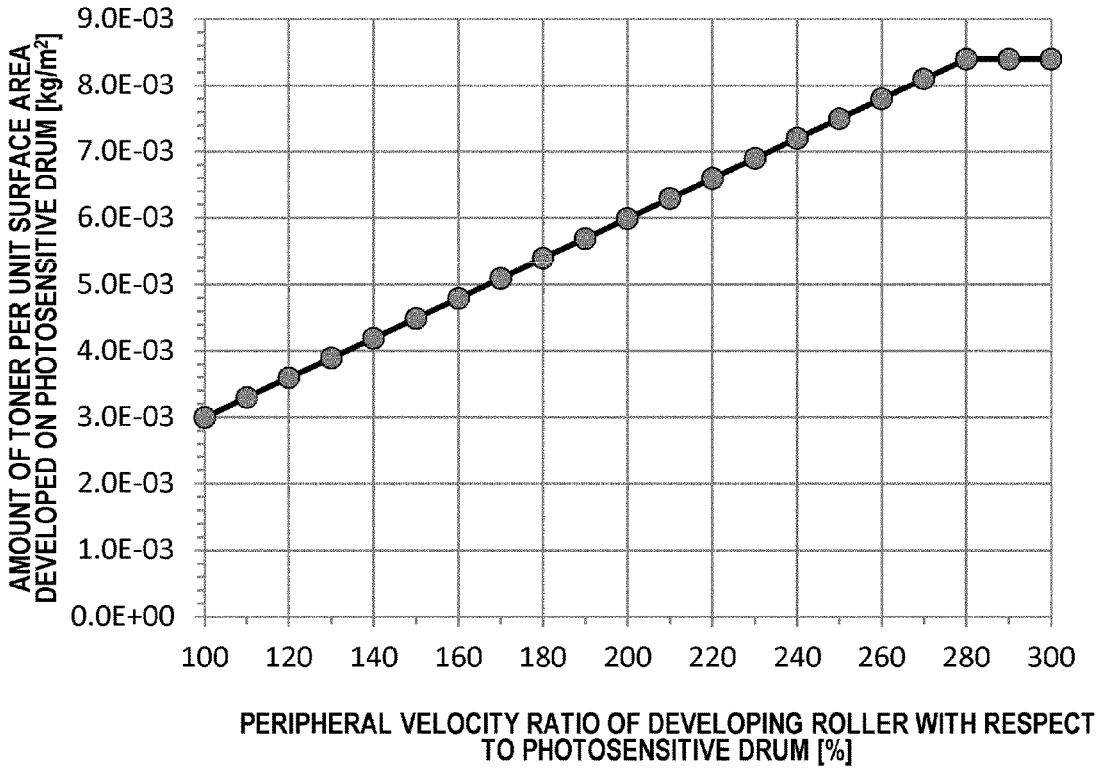
FIG. 4 is a graph showing the relationship between the peripheral velocity ratio and the toner amount per unit surface area of the photosensitive drum.

FIG. 4 is a graph showing the results obtained in measuring the relationship between the toner amount per unit surface area which is developed on the photosensitive drum when the peripheral velocity ratio, which is the ratio of the peripheral velocity of the developing roller to the peripheral velocity of the photosensitive drum, is changed. The potential setting of the photosensitive drum, the developing roller bias, and the toner charge quantity, and the like, are set as appropriate. As the peripheral velocity ratio of the developing roller to the photosensitive drum is increased from 100%, the amount of toner developed on the photosensitive drum (moved from the developing roller and placed on the photosensitive drum) increases, and the toner amount is saturated at a peripheral velocity ratio of about 280%.

Figure 5:
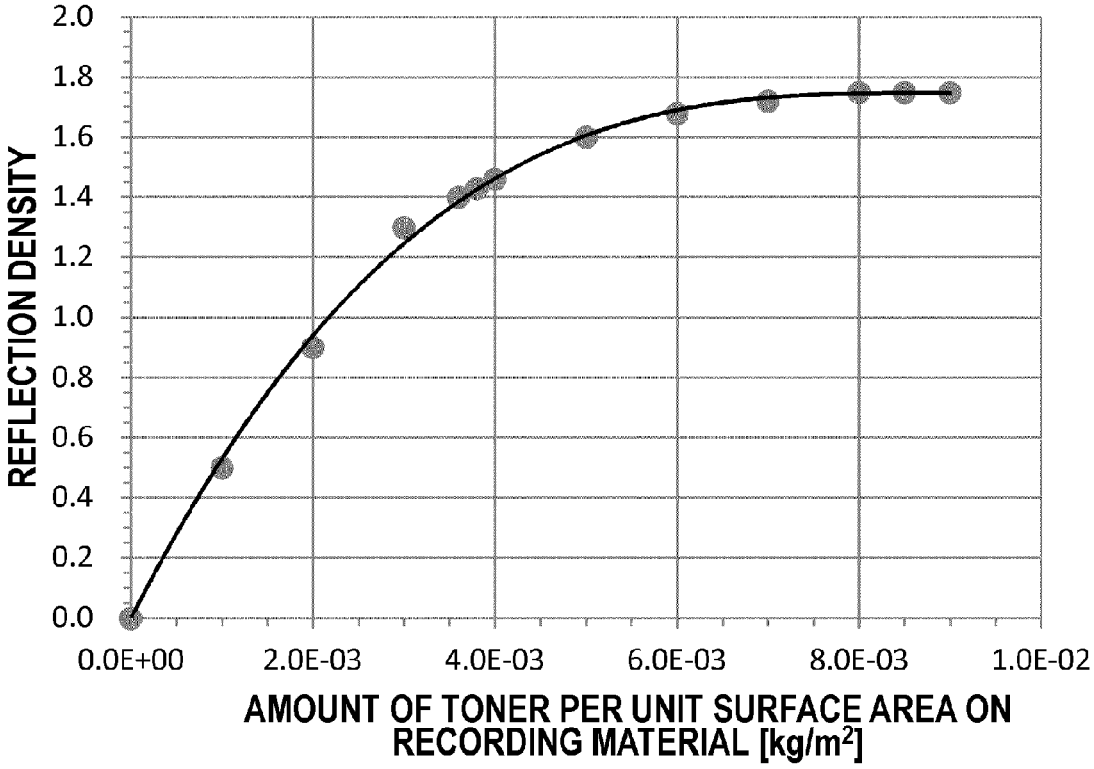
FIG. 5 is a graph showing the relationship between the amount of toner per unit surface area on a recording material and a reflection density.

FIG. 5 is a graph showing the relationship between the toner amount per unit surface area on the recording material and the reflection density, the relationship being measured after transferring and fixing the toner image developed on the photosensitive drum onto the recording material. The reflection density was measured using a reflection density measuring instrument Model RD-918 from GretagMacbeth GmbH. FIG. 5 shows magenta (M) toner as an example of YMCK. As the amount of toner on the recording material increases, the reflection density increases and the reflection density reaches saturation when the toner amount on the recording material is about 8E-03 [kg/m$^2$].

From the above results, in the present example, the normal image forming mode and the wide color gamut image forming mode were set in the following manner. As the normal image forming mode, since it is sufficient for a general office document, or the like, to have a reflection density of about 1.45, the peripheral velocity ratio of the photosensitive drum and the developing roller was set to 140% and the maximum toner amount on the recording material was set to about 4.0E-03 [kg/m$^2$] in a single color. As the wide color gamut image forming mode, the peripheral velocity ratio of the photosensitive drum and the developing roller was set to 280% and the maximum toner amount on the recording material was set to about 8.0E-03 [kg/m$^2$] in a single color.

The following means was used to increase the peripheral velocity ratio of the photosensitive drum and the developing roller to 280% in the wide color gamut image forming mode with respect to the peripheral velocity ratio of the photosensitive drum and the developing roller of 140% in the normal image forming mode. When the process speed in the normal image forming mode was taken as a 1/1 speed, in the wide color gamut image forming mode, the process speed was set to a 1/2 speed, the peripheral velocity (revolution speed) of the photosensitive drum was set to be half that in the normal image forming mode, and the peripheral velocity (revolution speed) of the developing roller was set to be the same as in the normal image forming mode. For example, the peripheral velocity of the developing roller is fixed at 0.28 [m/s], and the peripheral velocity of the photosensitive drum is set to 0.2 [m/s] in the normal image forming mode and to 0.1 [m/s] in the wide color gamut image forming mode.

For example, it is also possible to increase the peripheral velocity ratio of the photosensitive drum and the developing roller to 280% by increasing the peripheral velocity (revolution speed) of the developing roller by a factor of about two while maintaining the process speed at a 1/1 speed. In this case, the load applied to the driving motor as the driving source of the developing roller becomes large, and it is necessary to increase the fixing capability by raising the fixing temperature or the like. However, the image forming time can be shortened with respect to a process speed of a 1/2 speed. Meanwhile, where the process speed is set to a 1/2 speed, the load applied to the driving motor of the developing roller does not increase, and appropriate fixing is possible even without increasing the fixing temperature. Accordingly, in the present example, the setting for lowering the process speed is selected in the wide color gamut image forming mode.

Figure 6:
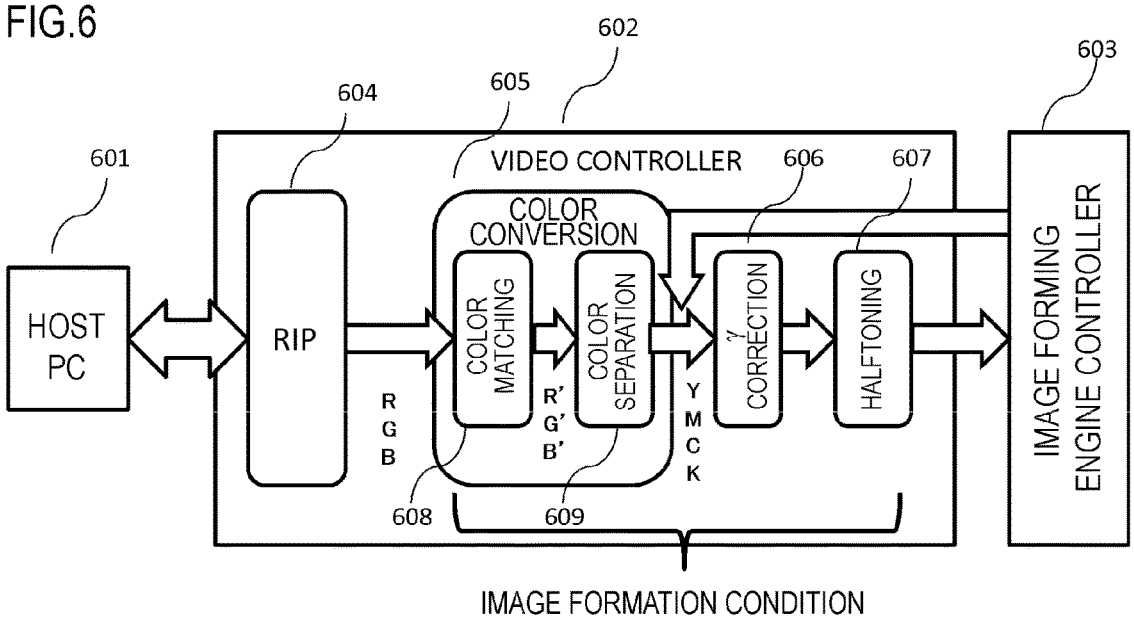
FIG. 6 is a block diagram of a control configuration of the image forming apparatus according to Example 1 of the present invention.

FIG. 6 is a block diagram showing an example of the configuration of the controller of the image forming apparatus according to the present example. From a host PC 601, a print job generally described in a page description language (PDL) such as PCL or PostScript is sent to a video controller 602 of the image forming apparatus. The video controller 602 as a conversion portion in the present example mainly includes a raster image processor (RIP) portion 604, a color conversion portion 605, a γ correction portion 606, and a halftoning portion 607.

The RIP portion 604 performs file analysis (interpreting) of a print job described by PDL sent from the host PC 601 and performs bitmap data conversion of RGB corresponding to the resolution (for example, 600 dpi) of the image forming apparatus.

The color conversion portion 605 performs conversion such as to match the tinges as much as possible in consideration of differences in color reproduction ranges between the devices and also match the appearance of colors, and further converts RGB into color data YMCK of the developers (toners). The color conversion portion 605 includes a color matching portion 608 that performs color matching between devices, and a color separation portion 609 that converts the color-matched color space data into toner data YMCK of respective colors of the image forming apparatus.

Generally, when a file created while watching a liquid crystal monitor with an application (image software, office suite software, etc.) on a computer is printed by an image forming apparatus, the color reproduction range (R'G'B') of the image forming apparatus is narrower than the color reproduction range (RGB) of the liquid crystal monitor. With consideration for this difference in color gamut between an input device (an image display device such as a liquid crystal monitor) and an output device (an electrophotographic printer or the like), the color matching portion 608 is used to perform color matching conversion such as to match the tinges as much as possible and also match the appearance of colors. The color separation portion 609 converts the R'G'B' which has been color-matched by the color matching portion 608 into color data YMCK of each developer.

The image data of each color of YMCK which have been converted and generated by the color separation portion 609 are gamma-corrected with the γ correction portion 606. The image data of each color of YMCK which have been gamma-corrected with the γ correction portion 606 are subjected to gradation expression processing such as dithering with the halftoning portion 607, and a signal is sent to the image forming engine controller.

The present invention is characterized in that the way by which image data are converted in the color matching portion 608, the color separation portion 609, the γ correction portion 606, and the halftoning portion 607 changes in accordance with the image forming mode. As an example thereof, in the present example, the case is explained in which the conversion condition of gamma correction as an image formation condition is caused to differ between the normal image forming mode and the wide color gamut image forming mode. However, the present invention is not limited to this example, and an image may be converted by taking the conversion condition of the color matching portion 608 as a first conversion condition in the normal image forming mode and as a second conversion condition in the wide color gamut image forming mode. Depending on the configuration, the gamma correction process may be omitted.

Figure 7:
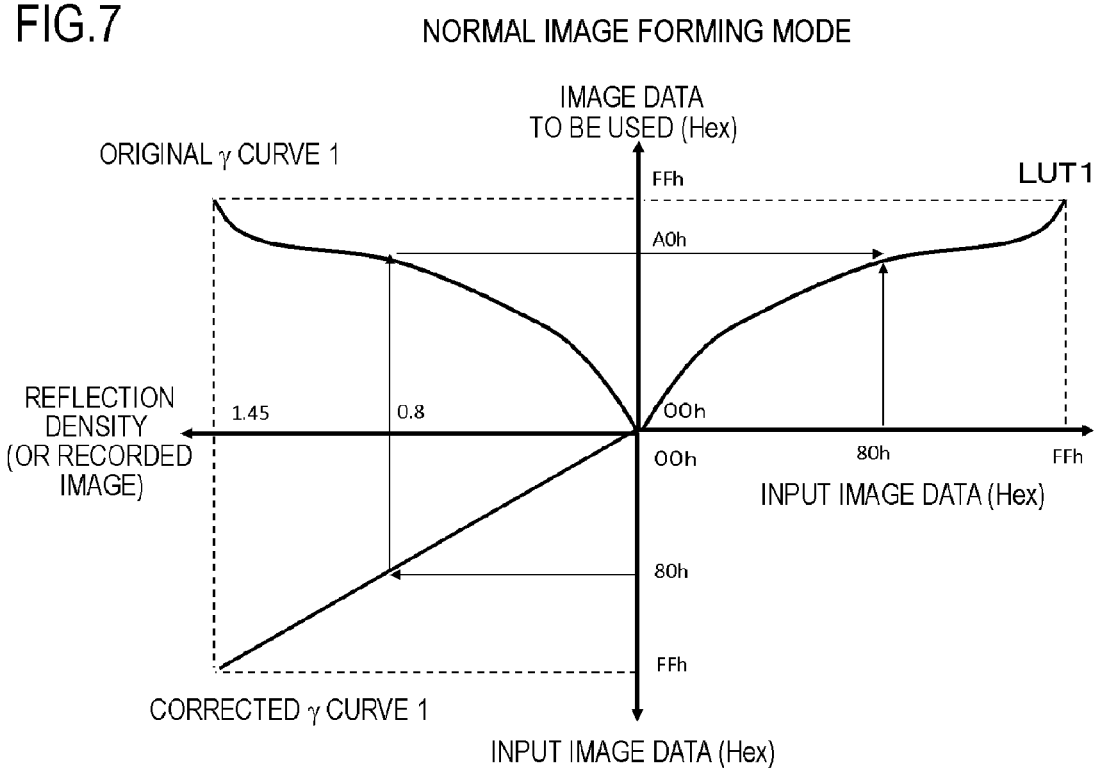
FIG. 7 is an explanatory drawing illustrating γ correction in the normal image forming mode in Example 1 of the present invention.

FIG. 7 is an explanatory diagram illustrating γ correction of image formation conditions in the normal image forming mode in the present example. The upper left graph in FIG. 7 is an original γ curve 1 showing the gradation characteristic in the case where an image (recorded image) is formed on the recording material by directly using the image data of the YMCK color expression converted from the image data of the RBG color expression in the color separation portion 609. Since the original γ curve 1 is not linear with respect to the image data, γ correction is performed to make it linear. The γ correction is performed using a look-up table (LUT). By performing the γ correction, it is possible to obtain a linear gradation characteristic of the image (recorded image) formed on the recording material. Therefore, as shown by the corrected γ curve 1, the relationship between the input image data (first image data) and the reflection density of the image formed on the recording material shows a linear gradation characteristic of the image formed in the recorded image.

For example, where it is desired to obtain a reflection density of 0.8 with respect to image data 80h, it follows from the original γ curve 1 that A0h can be used as image data to be actually used on the image forming apparatus side in order to obtain the reflection density of 0.8. The image data to be used correspond to converted second image data. Therefore, an association is established such as to use A0h as actual image data to be received on the image forming apparatus side when the input image data are 80h. A LUT is created by likewise associating a series of input image data with image data to be actually used. The LUT created in this way is a LUT 1 shown in the upper right graph in FIG. 7. As a result of using this LUT 1, the corrected γ curve 1 becomes linear as shown in the lower left graph in FIG. 7.

Figure 8:
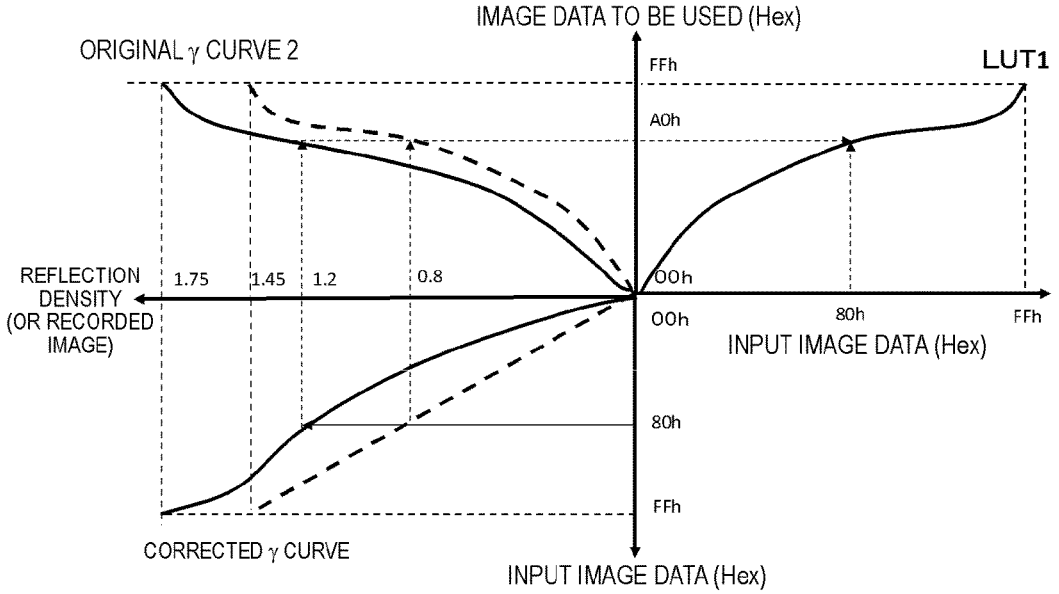
FIG. 8 is an explanatory drawing illustrating the case where γ correction of the normal image forming mode is performed in the wide color gamut image forming mode.

FIG. 8 is a diagram illustrating the case where the LUT 1 in the normal image forming mode is used as is in the wide color gamut image forming mode as a conventional example. In the wide color gamut image forming mode, the amount of toner placed per unit surface area on the recording material (a laid-on level of the developer per unit area of the recording material) is increased. Therefore, the original γ curve 2 showing the gradation characteristic in the case where image formation is performed by using as is the image data of YMCK color representation, which have been converted from image data of RGB color representation in the color separation portion 609 in the wide color gamut image forming mode, becomes as an upper left graph in FIG. 8. A broken line is the original γ curve 1 in the normal image forming mode.

As shown in the upper left section of FIG. 8, the original γ curve 2 in the wide color gamut image forming mode shows a gradation characteristic with a reflection density greater than that of the original γ curve 1 in the normal image forming mode over the entire gradation characteristic (from a minimum density of 00h to a maximum density of FFh). Therefore, where γ correction is performed using the LUT 1 in the normal image forming mode, for example, since the input image data are corrected to 80h so that the image data actually used in the LUT 1 become A0h, the density becomes as high as 1.2 in the original γ curve 2. Also, the corrected γ curve becomes nonlinear. For this reason, it is possible that the overall density will increase, the gradation of the image will be lost, or the appearance of color will change.

Figure 9:
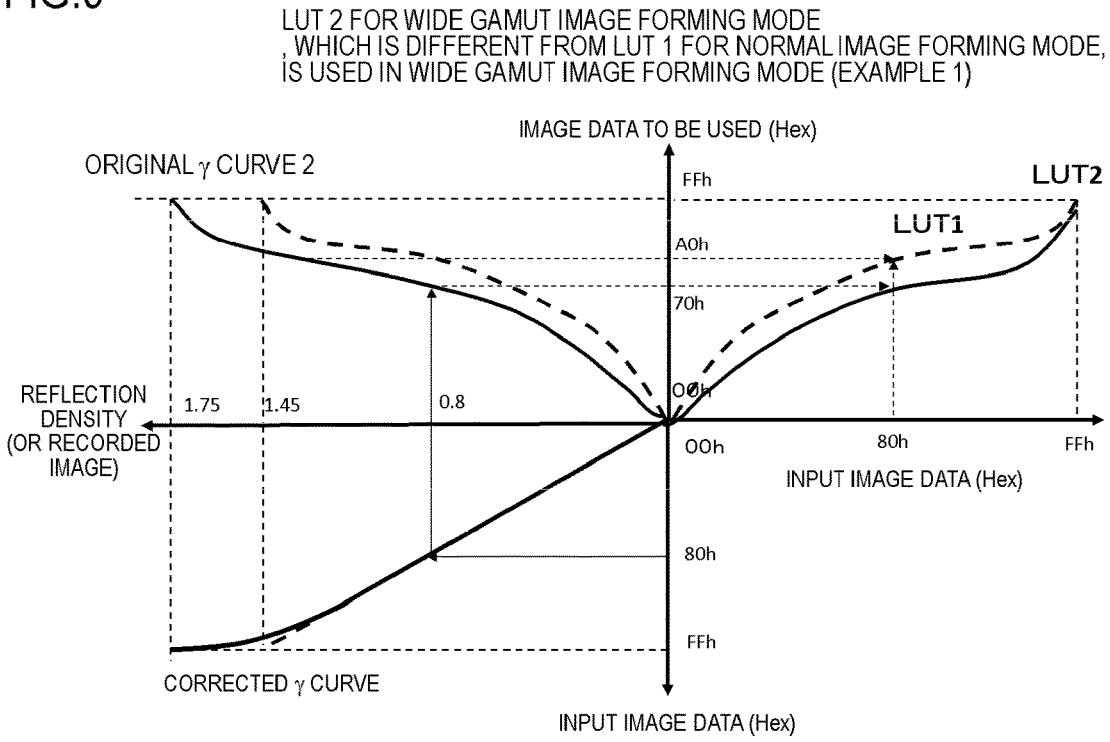
FIG. 9 is an explanatory drawing illustrating y correction in the wide color gamut image forming mode according in Example 1 of the present invention.

FIG. 9 is a diagram for explaining the case where an image formation condition different from the image formation condition in the normal image forming mode is used in the wide color gamut image forming mode in the present example. The present invention is characterized in that an image formation condition different from the image formation condition in the normal image forming mode is used in the wide color gamut image forming mode. In the present example, as an image formation condition different from that in the normal image forming mode, a LUT 2 which is different from the LUT 1 used in the normal image forming mode is used as a LUT that defines the conversion condition of image data in γ correction.

The LUT 1 is a LUT in which the entire gradation characteristic of the image outputted to the recording material in the normal image forming mode shows linear gradation of an image. Thus, this is a LUT in which image data (output image data) to be actually used are allocated with respect to the original image data (input image data) so as to show a linear gradation characteristic over the entire density range from the minimum density 00h to the maximum density FFh. The gradation characteristic of the image data to be outputted to the recording material which is obtained with the LUT 1 corresponds to the first gradation characteristic in the present example. The conversion condition defining the association between the input image data and the output image data such as to realize this gradation characteristic corresponds to the first conversion condition in the present example.

In the present example, the LUT 2 can be exemplified by a LUT in which input image data and output image data are associated so that the color gamut widens in a high-density region (second density region) which is close to a solid region so that the corrected γ curve becomes the same as the corrected γ curve in the normal image forming mode in the middle- and low-density regions (first density region). Thus, from 00h to 60h and from 61h to C7h (low- and medium-density regions), a linear gradation characteristic (constant density increase rate until FFh=1.45) is shown in the case in which the maximum density (reflection density at FFh) is made the same as the maximum density (1.45) in the normal image forming mode. Further, from C8h to ffh (high-density region), gradation of an image is shown such that the density increase rate gradually increases with respect to the constant density increase rate in the middle- and low-density regions. The gradation characteristic obtained with the LUT 2 corresponds to the second gradation characteristic in the present invention, and the conversion condition defining the association between the input image data and the output image data corresponds to the second conversion condition in the present invention so as to realize such a gradation characteristic. As a result, it is possible to widen the color gamut while ensuring the gradation of a halftone image in the wide color gamut image forming mode.

Figure 10:
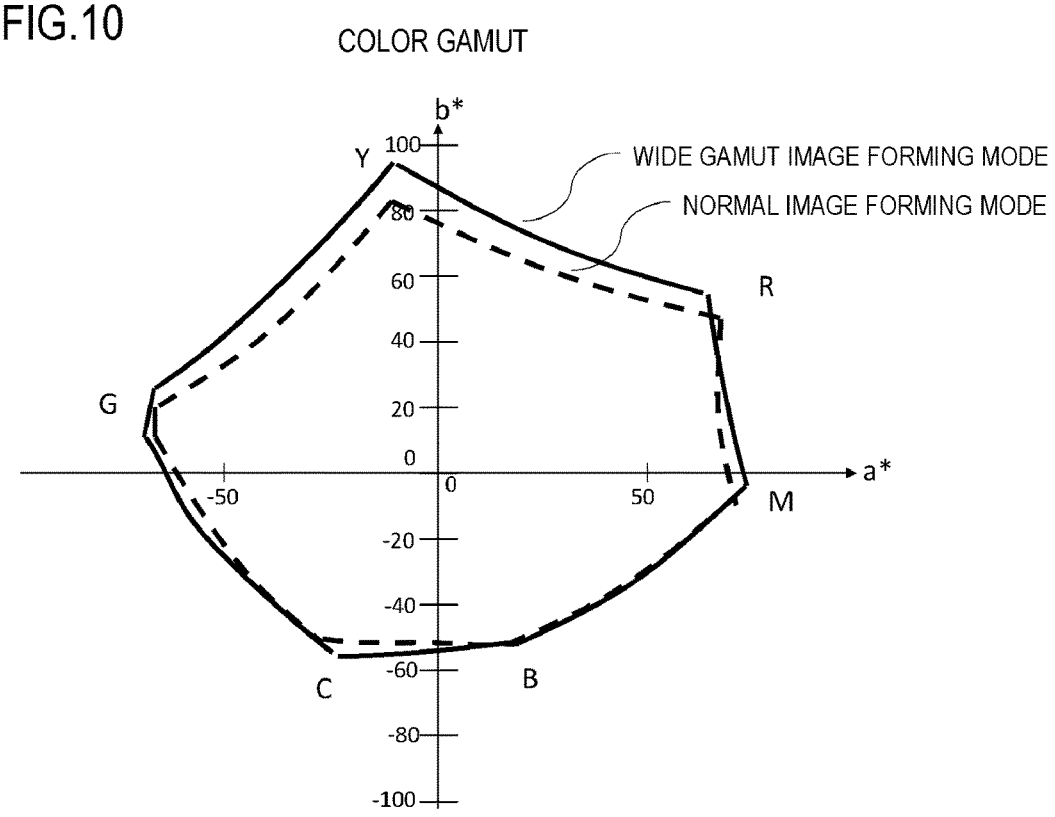
FIG. 10 is a chromaticity diagram in Example 1 of the present invention.

FIG. 10 is a chromaticity diagram illustrating the comparison between the color gamut in the case of forming a color image in the normal image forming mode and the color gamut in the case of forming a color image in the wide color gamut image forming mode in the present example. The broken line is the color gamut in the normal image forming mode, and the solid line is the color gamut in the wide image forming mode. A L*a*b* colorimetric system (CIE) was used to evaluate the color gamut. An L axis in the L*a*b* colorimetric system (CIE) is the axis perpendicular to the paper plane in FIG. 10, and only an a axis and a b axis are shown in FIG. 10. The same applies to FIGS. 11 and 12. The chromaticity was measured using Spectordensitometer 500 manufactured by X-Rite Inc. FIG. 10 shows changes in color gamut when the control in the wide color gamut image forming mode of the present invention is implemented in the same way in the process cartridges of yellow (Y), magenta (M), and cyan (C) colors which are basic colors in color image formation. It is clear that as a result of switching from the normal image forming mode to the wide color gamut image forming mode, for example, the color gamut of red (R) formed by yellow (Y) and magenta (M) and the color gamut of green (G) formed by yellow (Y) and cyan (C) are enlarged. For yellow (Y) and red (R), the color gamut can be enlarged from 5% to 15%. For the wide color gamut image forming mode, the present invention can be also applied to the case where only the color gamut of a specific tinge is enlarged. For example, when enlarging only the color gamut of blue (B) formed by magenta (M) and cyan (C), the wide color gamut image forming mode may be implemented only for the magenta and cyan process cartridges among the four process cartridges.

EXAMPLE 2

An image forming apparatus according to Example 2 of the present invention will be described hereinbelow with reference to FIGS. 11 and 12. In Example 2, components which are the same as in Example 1 are assigned with the same reference numerals as in Example 1, and the explanation thereof is herein omitted. Matters not described herein in Example 2 are the same as those in Example 1. Example 2 is characterized in that the color matching conversion table which is used for processing in the color matching portion 608 of the color conversion portion 605 is switched between the normal image forming mode and the wide color gamut image forming mode as the image formation condition.

Figure 11:
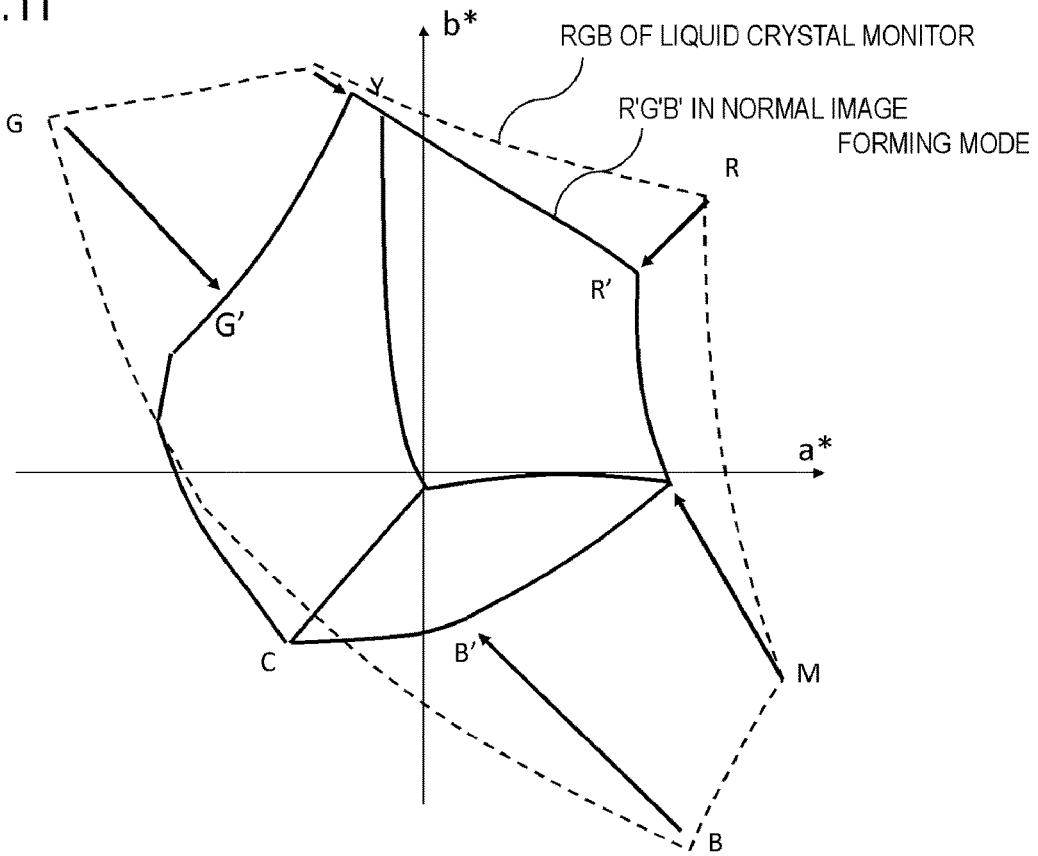
FIG. 11 is an explanatory drawing illustrating color matching conversion in the normal image forming mode.

FIG. 11 is a diagram showing how the color gamut range of RGB color expression is changed by color matching conversion in the normal image forming mode in the present example. The broken line indicates the color reproduction range (for example, sRGB) of a liquid crystal monitor which is an input device. Meanwhile, the solid line indicates the color reproduction range of the output image of the image forming apparatus which is an output device, and corresponds to the first color reproduction range in the present invention. The color reproduction range of the electrophotographic output image is narrower than the color reproduction range of the input device. Therefore, the RGB values of the input device color space are converted into R'G'B' values which have been color-matched to the output device color space. In other words, in many cases, the ratio of each color of RGB, when displaying a predetermined color in the input device, cannot be used as is when outputting with the output device because of the difference in color gamut range between the input device and the output device. Accordingly, the ratio of RGB constituting the predetermined color on the input device and the ratio of R'G'B' constituting the predetermined color to be outputted by the output device are associated for each outputable color, as indicated by the following equation, and the table in which the conversion conditions are summarized is a color matching conversion table.

$$\begin{bmatrix} R' \\ G' \\ B' \end{bmatrix} = \begin{bmatrix} a_{11} & a_{12} & a_{13} \\ a_{21} & a_{22} & a_{23} \\ a_{31} & a_{32} & a_{33} \end{bmatrix} \begin{bmatrix} R \\ G \\ B \end{bmatrix} \quad \text{(Math. 2)}$$

Next, color matching conversion in the wide color gamut image forming mode will be explained. Where the color matching conversion table used in the wide color gamut image forming mode is the same as that in the normal image forming mode, as in the related art, since the color gamut is changed to the same color gamut, the color gamut cannot be widened. By contrast, the present example is characterized in that a color matching conversion table different from the color matching conversion table in the normal image forming mode is used in the wide color gamut image forming mode.

Figure 12:
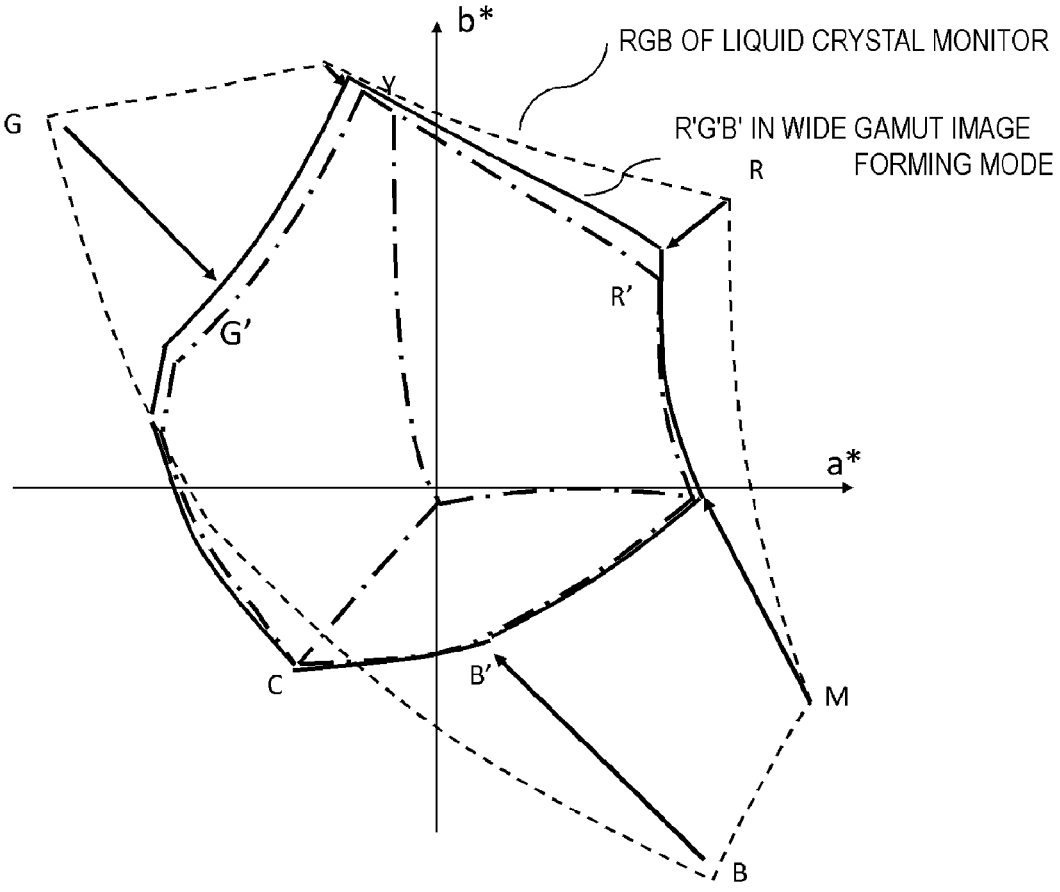
FIG. 12 is an explanatory drawing illustrating color matching conversion in the wide image forming mode.

FIG. 12 is a diagram showing how the color gamut range of RGB color expression is changed by color matching conversion in the wide color gamut image forming mode in the present example. The broken line indicates the RGB color space of the input device, the one-dot broken line indicates the R'G'B' color space in the normal image forming mode, and the solid line indicates the R'G'B' color space in the wide color gamut image forming mode. The color reproduction range indicated by the solid line corresponds to the second color reproduction range in the present invention. As shown in FIG. 12, since the R'G'B' color space in the wide color gamut image forming mode is made wider than that in the normal image forming mode, the color gamut can be widened. Color matching conversion in the normal image forming mode is performed in the following manner. The association (color matching conversion) between the RGB color space and the R'G'B' color space is performed such as to obtain the appearance of colors which is as uniform as possible. Further, since the RGB color space is wider than the R'G'B' color space, a region outside the R'G'B' color space is closely associated with the outer peripheral edge region of the R'G'B' color space. By contrast, since the color matching conversion in the wide color gamut image forming mode performs association to the R'G'B' color space which is wider than that in the normal image forming mode, the reproducible tinges are further increased. As a result, the appearance of colors can be better matched. Further, with respect to a region outside of the R'G'B' color space, the association with the outer peripheral edge region of the R'G'B' color space can be performed more sparsely than in the normal image forming mode. As a result, a more natural appearance of colors can be obtained. The effect obtained in Example 2 which is different from those obtained in Example 1 is that the appearance of colors can be matched as much as possible.

EXAMPLE 3

An image forming apparatus according to Example 3 of the present invention will be described hereinbelow with reference to FIG. 13. In Example 3, components which are the same as in Examples 1 and 2 are assigned with the same reference numerals as in Examples 1 and 2, and the explanation thereof is herein omitted. Matters not described herein in Example 3 are the same as those in Examples 1 and 2. In Examples 1 and 2, the user designates, by using an operation panel (not shown in the drawing) of the image forming apparatus 200 or a host PC, whether the image forming mode is to be set to the normal image forming mode or the wide color gamut image forming mode. By contrast, in Example 3, the configuration is used in which the image forming apparatus 200 can designate the image forming mode by itself.

In the present example, the engine controller 603 determines whether the image for which image formation has been designated to be performed is the normal image to be outputted in the normal image forming mode or a wide color gamut image to be outputted in the wide color gamut image forming mode, as wide color gamut image determining means. The determination is made on the basis of whether image data of the image for which image formation has been designated are normal image data as non-wide-color-gamut image data, or wide color gamut image data. Non-wide-color-gamut image data are image data composed only of dot data with a density less than a predetermined threshold, and are data that can be outputted with sufficient color expression in the normal image forming mode. The wide color gamut image data are image data including dot data with a density equal to or greater than the predetermined threshold value, and are data that need to be outputted in the wide color gamut image forming mode because they cannot be sufficiently color-expressed in the normal image forming mode.

The engine controller 603 automatically switches the operation mode to the normal image forming mode or the wide color gamut image forming mode according to the determination result and performs image formation under the image formation condition corresponding to the respective image forming mode. Here, it may be also preferable to switch the modes with the engine controller 603 in preference to mode designation by the user. For example, in some cases, although the user has designated the wide color gamut image forming mode, the image data thereof are image data that can be outputted in the color gamut range in the normal image forming mode. In this case, it is possible to improve productivity by outputting in the normal image forming mode rather than outputting in the wide color gamut image forming mode in which more time is required till the output because of the change in the peripheral velocity ratio.

Figure 13:
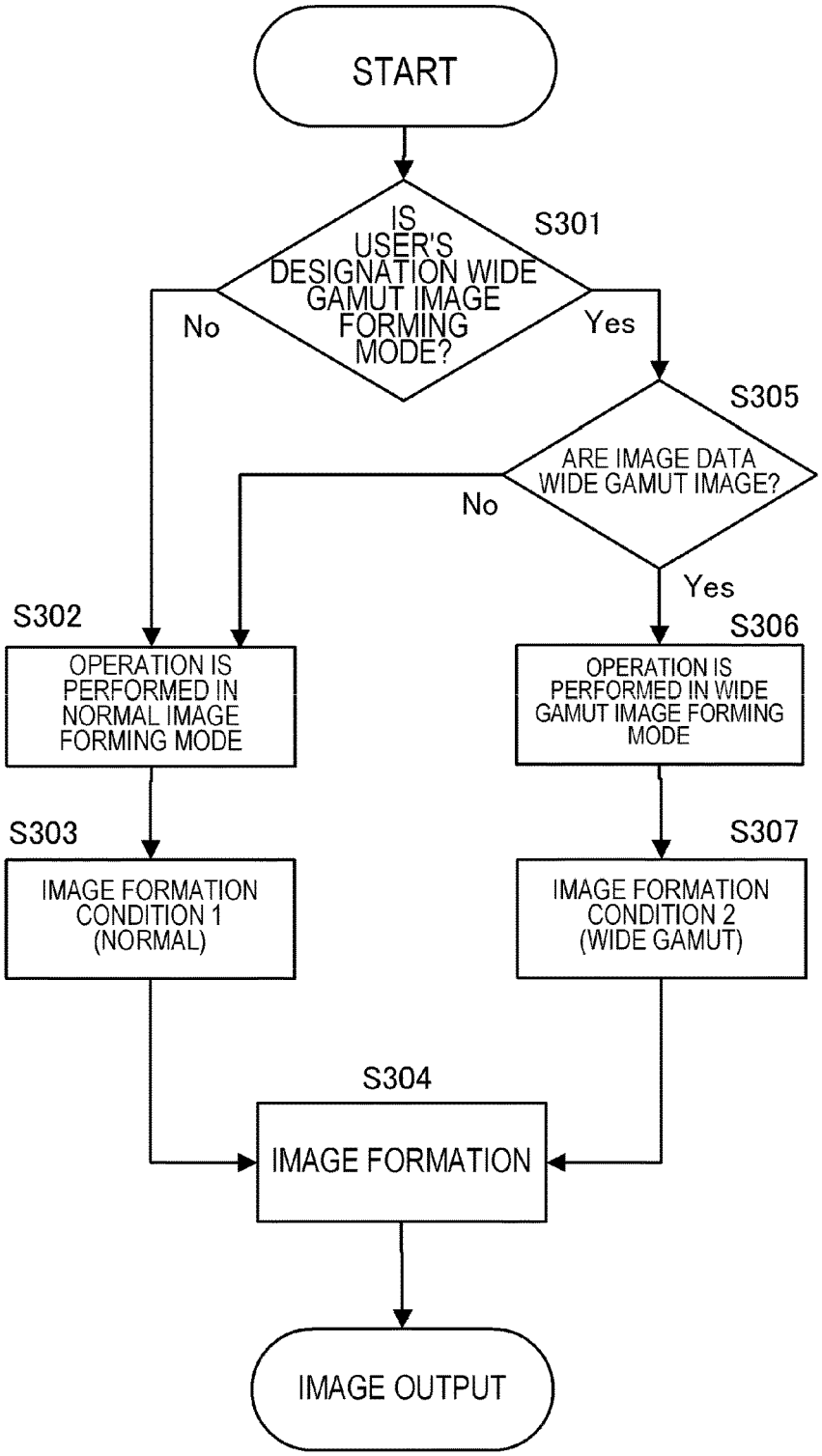
FIG. 13 is a flowchart of image forming mode selection in Example 3 of the present invention.

FIG. 13 is a flowchart showing the flow of automatic selection control of the image forming mode at the time of the image forming operation of Example 3 of the present invention. According to the flowchart shown in FIG. 13, the engine controller 603 selects the image forming mode, sets the image formation condition, and causes the image forming apparatus 200 to execute the image forming operation. First, where the image forming operation mode designated by the user is not the wide color gamut image forming mode (S301, No), that is, where the user designates the normal image forming mode, the engine controller 603 selects the normal image forming mode (S302). Then, the engine controller 603 selects γ correction or color matching conversion table as the image formation condition for the normal image forming mode, which has been described in Examples 1 and 2, as the image formation condition (S303), and performs correction, or the like, of the predetermined image data to form an image (S304).

In the configuration of the present example, when the user selects the normal image forming mode, the contents of the image data to be outputted are not verified, that is, it is not determined whether the image data are of the normal image or of the wide color gamut image. This is because even when the original image data are wide color gamut data, the user does not necessarily obtain the image output in the wide color gamut. A configuration different from that of the present example may be also used in which even when the user selects the normal image forming mode, an image forming mode suitable for the contents of the image data is automatically selected.

When the image forming operation mode designated by the user is the wide color gamut image forming mode (S301, Yes), it is determined whether the image data to be outputted are image data of a normal image or image data of a wide color gamut image (S305). Where the image data are image data of a normal image (S305, No), the normal image forming mode is selected (S302), and image formation in the normal image forming mode is executed (S303, S304). Meanwhile, where the image data are image data of a wide color gamut image (S305, Yes), the wide color gamut image forming mode is selected (S306), the image formation condition for the wide color gamut image forming mode is selected (S307), and image formation is performed (S304).

The determination of the image data may be based on the state of RGB image data. For example, in the case of 8-bit data of each color of RGB, where dot data of C8h or more are present in any of the color data, the image is determined to be a wide color gamut image. When color data are composed only of dot data less than C8h, the image is determined to be a normal image. After the determination, the operation is performed in the image forming mode corresponding to the determination result, and the image formation is performed under the image formation condition corresponding to the image forming mode.

Alternatively, the image determination may be performed with YMCK data after conversion from RGB to YMCK data. For example, when each color of YMCK is set to 8-bit data, where dot data of C8h or more are included in any of the color data, the image is determined to be a wide color gamut image. When color data are all composed only of dot data less than C8h, the image is determined to be a normal image.

In the present example, the threshold value was set to C8h from the viewpoint of whether or not the image data in a high density region (C8h to FFh) in the present example are included in the color data, but the determination threshold is not limited to the aforementioned C8h and may be set appropriately.

According to the present example, when the wide color gamut image forming mode is designated and the actual print image is a normal image which inherently does not necessarily require image formation in the wide color gamut, the decrease in the productivity of the print caused by operation in the wide color gamut image forming mode can be prevented.

In the above-described examples, the case is explained in which the image forming apparatus itself has the configuration such that final image data to be used for image formation are generated by processing, e.g., γ correcting, the original image data, but configurations to which the present invention can be applied are not limited to the aforementioned configuration. For example, in an image forming system including an image forming apparatus, a host CPU, and other peripherals such as a display, the present invention can be also applied to a configuration in which the host CPU functions as a data generating device for performing processing and generation, such as correction, of the image data.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-072514, filed on Mar. 31, 2016, which is hereby incorporated by reference herein in its entirety.

What is claimed is:

1. An image forming apparatus comprising:

an image bearing member on which an electrostatic image is formed;

a developer bearing member that develops the electrostatic image, which has been formed on the image bearing member, with a developer; and a control portion that controls the image bearing member and the developer bearing member so as to enable execution of a first image forming operation by which a recorded image is formed by rotating the image bearing member and the developer bearing member at a first peripheral velocity ratio and a second image forming operation by which a recorded image is formed by rotating the image bearing member and the developer bearing member at a second peripheral velocity ratio which is greater than the first peripheral velocity ratio, where the peripheral velocity ratio is defined as a ratio of a peripheral velocity of the developer bearing member to a peripheral velocity of the image bearing member, wherein the control portion:

has a conversion portion that converts image data, which are used for forming the recorded image, by using either a first conversion condition which has been set so as to obtain a first gradation characteristic in the recorded image when the first image forming operation is executed or a second conversion condition which has been set so as to obtain a second gradation characteristic, which is different from the first gradation characteristic, in the recorded image when the second image forming operation is executed, and enables the first image forming operation or the second image forming operation to be performed on the basis of image data converted by the conversion portion.

2. The image forming apparatus according to claim 1, wherein the second gradation characteristic is a gradation characteristic which is the same as the first gradation characteristic in a first density region in the recorded image and is a gradation characteristic such that a density increase rate gradually increases in a second density region where density is higher than in the first density region.

3. The image forming apparatus according to claim 1, wherein in the first gradation characteristic, a density increase rate is constant over the entire density range in the recorded image.

4. The image forming apparatus according to claim 1, wherein the control portion executes the first image forming operation when only dot data with a density less than a predetermined threshold are included in the image data to be converted in the conversion portion; and the conversion portion converts the image data by using the first conversion condition during the first image forming operation.

5. The image forming apparatus according to claim 4, wherein the control portion executes the second image forming operation when dot data with a density of at least the predetermined threshold are included in the image data to be converted in the conversion portion; and the conversion portion converts the image data by using the second conversion condition during the second image forming operation.

6. The image forming apparatus according to claim 5, wherein the execution of either of the first image forming operation and the second image forming operation is designatable.

7. The image forming apparatus according to claim 6, wherein the control portion executes the first image forming operation when only dot data with a density less than the predetermined threshold are included in the image data, even when the execution of the second image forming operation is designated.

8. The image forming apparatus according to claim 1, wherein the conversion portion converts the image data by gamma correction.

9. The image forming apparatus according to claim 1, wherein a laid-on level of the developer per unit area of the recording material in the recorded image in the second image forming operation is greater than the laid-on level in the first image forming operation.

10. The image forming apparatus according to claim 1, wherein a peripheral velocity of the image bearing member in the second image forming operation is lower than the peripheral velocity of the image bearing member in the first image forming operation.

11. The image forming apparatus according to claim 1, wherein the second peripheral velocity ratio is set such that a laid-on level of the developer per unit area of the recording material in the recorded image at the second peripheral velocity ratio is larger than that at the first peripheral velocity ratio.

12. The image forming apparatus according to claim 1, further comprising an exposure portion for exposing a surface of the image bearing member to form an electrostatic image on the surface;

a transfer portion for transferring a developer image borne by the image bearing member to the recording material; and a fixing portion for fixing the developer image to the recording material.

13. An image forming apparatus comprising:

an image bearing member on which an electrostatic image is formed;

a developer bearing member that develops the electrostatic image, which has been formed on the image bearing member, with a developer; and a control portion that controls the image bearing member and the developer bearing member so as to enable execution of a first image forming operation by which a recorded image is formed by rotating the image bearing member and the developer bearing member at a first peripheral velocity ratio and a second image forming operation by which a recorded image is formed by rotating the image bearing member and the developer bearing member at a second peripheral velocity ratio which is greater than the first peripheral velocity ratio, where the peripheral velocity ratio is defined as a ratio of a peripheral velocity of the developer bearing member to a peripheral velocity of the image bearing member, wherein the control portion:

has a conversion portion that converts image data, which are used for forming the recorded image, by using either a first conversion condition for outputting the recorded image in a first color reproduction range when the first image forming operation is executed or a second conversion condition for outputting the recorded image in a second color reproduction range, which is wider than the first color reproduction range, when the second image forming operation is executed, and enables the first image forming operation or the second image forming operation to be performed on the basis of image data converted by the conversion portion.

14. The image forming apparatus according to claim 13, wherein the conversion of the image data performed by the conversion portion is a color matching conversion for matching tinges between an image displayed by an image display device that displays an image on the basis of image data before the conversion, and an image formed on a recording material on the basis of image data after the conversion.

15. The image forming apparatus according to claim 13, wherein a laid-on level of the developer per unit area of the recording material in the recorded image in the second image forming operation is greater than the laid-on level in the first image forming operation.

16. The image forming apparatus according to claim 13, wherein a peripheral velocity of the image bearing member in the second image forming operation is lower than the peripheral velocity of the image bearing member in the first image forming operation.

17. The image forming apparatus according to claim 13, wherein the second peripheral velocity ratio is set such that a laid-on level of the developer per unit area of the recording material in the recorded image at the second peripheral velocity ratio is larger than that at the first peripheral velocity ratio.

18. The image forming apparatus according to claim 13, further comprising an exposure portion for exposing a surface of the image bearing member to form an electrostatic image on the surface;

a transfer portion for transferring a developer image borne by the image bearing member to the recording material; and a fixing portion for fixing the developer image to the recording material.

* * * * *